US007976112B2

(12) United States Patent
Stock

(10) Patent No.: US 7,976,112 B2
(45) Date of Patent: Jul. 12, 2011

(54) CABINET DRAWER AND STATIONARY DRAWER GLIDE

(75) Inventor: Michael J. Stock, Ames, IA (US)

(73) Assignee: Hirsh Industries, Inc., Urbandale, IA (US)

( * ) Notice: Subject to any disclaimer, the term of this patent is extended or adjusted under 35 U.S.C. 154(b) by 355 days.

(21) Appl. No.: 11/640,609

(22) Filed: Dec. 18, 2006

(65) Prior Publication Data

US 2008/0143225 A1 Jun. 19, 2008

(51) Int. Cl.
*A47B 88/00* (2006.01)

(52) U.S. Cl. ..... 312/334.7; 312/334.1

(58) Field of Classification Search ..... 312/334.1, 312/334.5, 334.7, 334.8, 334.16; 384/22, 384/23

See application file for complete search history.

(56) References Cited

U.S. PATENT DOCUMENTS

| | | | | | |
|---|---|---|---|---|---|
| 2,882,780 | A | * | 4/1959 | Edwards | 411/337 |
| 3,321,253 | A | * | 5/1967 | Everburg | 384/23 |
| 3,351,406 | A | * | 11/1967 | Ropiequet et al. | 312/332 |
| 3,477,770 | A | * | 11/1969 | Niemi | 384/23 |
| 3,750,993 | A | * | 8/1973 | Read | 248/298.1 |
| 3,897,981 | A | * | 8/1975 | Kaplan et al. | 384/23 |
| 3,991,537 | A | * | 11/1976 | Brown | 52/718.05 |
| 4,108,519 | A | | 8/1978 | Chervenak | |
| 4,138,176 | A | * | 2/1979 | Cowdroy | 312/334.16 |
| 4,172,625 | A | * | 10/1979 | Swain | 384/23 |
| 4,244,546 | A | * | 1/1981 | Mertes et al. | 248/258 |
| 4,274,689 | A | | 6/1981 | Vander Ley et al. | |
| 4,440,455 | A | | 4/1984 | Lanting et al. | |
| 4,534,600 | A | * | 8/1985 | Cosme | 384/23 |
| RE32,134 | E | | 5/1986 | Gutner et al. | |
| 4,986,674 | A | | 1/1991 | Decker et al. | |
| 5,037,165 | A | | 8/1991 | Rapp et al. | |
| 5,090,787 | A | * | 2/1992 | Harley | 312/334.7 |
| 5,163,568 | A | * | 11/1992 | Laurendeau et al. | 211/187 |
| 5,330,063 | A | * | 7/1994 | Remmers | 211/162 |
| 5,378,057 | A | | 1/1995 | Bach et al. | |
| 5,403,097 | A | | 4/1995 | Woof | |
| 5,407,084 | A | | 4/1995 | Remmers | |
| 5,484,197 | A | * | 1/1996 | Hansen et al. | 312/334.12 |
| 5,580,174 | A | | 12/1996 | Houck | |
| 5,785,400 | A | | 7/1998 | Grieser et al. | |
| 5,927,839 | A | | 7/1999 | Alfaro | |
| 6,116,706 | A | | 9/2000 | Pomerleau et al. | |
| 6,288,902 | B1 | * | 9/2001 | Kim et al. | 361/725 |

(Continued)

OTHER PUBLICATIONS

About.com "Composites/Plastics—Acetal Copolymer Resins", Copyright (C) 1989 CRC Press LLC., <http://composite.about.com/library/glossary/a/bldef-a62.htm>.*

*Primary Examiner* — Darnell M Jayne
*Assistant Examiner* — Andres Gallego
(74) *Attorney, Agent, or Firm* — Ryndak & Suri LLP

(57) ABSTRACT

A stationary drawer glide and cabinet drawer are provided. The stationary drawer glide and cabinet drawer incorporating the drawer glide allow for a user to easily slide open and closed a cabinet drawer without causing damage or warping to the cabinet drawer, even if there are heavy objects in the drawer. The drawer glide includes a fastening portion adapted to be affixed to an interior cabinet wall, and top and bottom portions for supporting a drawer. The drawer glide may be made of a material with a smooth surface with a low coefficient of friction to facilitate easy gliding of the cabinet drawer.

14 Claims, 4 Drawing Sheets

U.S. PATENT DOCUMENTS 6,467,860 B2 10/2002 Remmers
6,471,311 B1 10/2002 Snyder
6,485,120 B1 11/2002 Pomerleau et al.
6,497,185 B1 12/2002 Barrett et al.
6,557,960 B2 * 5/2003 Shih ..... 312/334.5
6,626,509 B2 9/2003 Remmers
6,853,549 B2 * 2/2005 Xu ..... 361/679.39
6,857,711 B1 2/2005 Straus
7,180,734 B2 * 2/2007 Jing ..... 361/679.33
7,275,646 B2 * 10/2007 Mimlitch, III et al. ..... 211/26
7,327,565 B2 * 2/2008 Chen et al. ..... 361/679.33
7,469,791 B2 * 12/2008 Phoy ..... 211/59.2
2003/0173882 A1 * 9/2003 Koons ..... 312/404
2004/0017139 A1 1/2004 Mueller et al.
2005/0184630 A1 8/2005 Bonanno et al.

* cited by examiner

CABINET DRAWER AND STATIONARY DRAWER GLIDE

FIELD OF THE INVENTION

The present invention relates to a drawer glide for use in a cabinet drawer and a cabinet drawer for use in a cabinet.

BACKGROUND OF THE INVENTION

Often times, cabinet drawers contain heavy items such as paper files. When the cabinet drawer contains heavy items, it typically becomes difficult to quickly open without damaging or warping the drawer. The drawer will not easily slide open. More expensive drawers have mechanisms that allow them to more easily slide, however, these mechanisms are expensive and not economical for a simple file cabinet for someone not looking to invest a lot of money.

In view of the foregoing, there exists a need for a cabinet drawer and stationary drawer glide that will easily open, even when there are heavy items in the cabinet. Additionally, there exists a need for a drawer glide that will allow a drawer to be easily opened without damaging or warping the cabinet drawer. There also exists a need for a cabinet drawer and drawer glide that can be easily and inexpensively manufactured.

SUMMARY OF THE INVENTION

In accordance with the present invention, a cabinet drawer and stationary drawer glide are provided. The cabinet drawer and stationary drawer glide are particularly useful for storing heavy items such as paper in a drawer, while still allowing quick and easy opening of the drawer. The cabinet drawer and stationary drawer glide are also particularly useful to allow the drawer to store heavy items without warping or damaging the drawer when it is opened.

In one aspect of the invention, a stationary drawer glide for attachment to a cabinet wall is provided. The drawer glide comprises a fastening portion adapted to be affixed to a cabinet wall comprising at least one fastening member; an elongated, substantially flat upper plateau, load-bearing top portion for supporting a drawer; an elongated, substantially flat, load-bearing bottom portion for supporting a drawer; at least one horizontal side portion; and two vertical side portions.

The load-bearing top portion and load-bearing bottom portion can be of any length and width as appropriate to facilitate a cabinet drawer to easily open and close. Typically, the top portion will be essentially the same length and width as the bottom portion. Typically, the top and bottom portions are between approximately 3 and 9 inches long and between approximately ¼ and 2 inches wide. More typically, the top and bottom portions are between approximately 4 and 6 inches long and between about ½ and 1 inch wide. Most typically, the top and bottom portions are approximately 5 inches long and ½ inch wide.

The horizontal side portion may be any length and width as appropriate. Typically, the horizontal side portion is approximately the same length as the top and bottom portions. Typically, the horizontal side portion is between approximately 2 and 9 inches long and between approximately ¼ and 3 inches wide. More typically, the horizontal side portion is between approximately 4 and 6 inches long and between approximately ½ and 2 inches wide. Most typically, the horizontal side portion is approximately 5 inches long and 1 inch wide.

The vertical side portions may be any height and width as appropriate. Typically, the height of the vertical side portion is approximately the same as the width of the horizontal side portion and the width of the vertical side portion is approximately the same as the width of the top and bottom portions. Typically, the vertical side portion is between approximately ¼ and 3 inches high and between approximately ½ and 2 inches wide. More typically, the vertical side portion is between approximately ½ and 2 inches high and between approximately ½ and 1 inch wide. Most typically, the vertical side portion is approximately 1 inch high and ½ inch wide.

The drawer glide may comprise any suitable material. Preferably, the upper plateau comprises high density polyethylene or an acetal copolymer, which is available under the trademark Celcon®. Other materials may be used as desired, and include, for example, polypropylene, nylon or ABS. Typically, the upper plateau of the stationary drawer glide has an essentially smooth surface. The bottom portion of the drawer glide may have an essentially smooth surface. The vertical and horizontal side portions may also have an essentially smooth surface. Typically, the upper plateau, bottom portion, vertical side portions, and bottom side portions all have an essentially smooth surface. The smooth surface helps facilitate the easy gliding of the cabinet drawer when opening and closing the cabinet drawer.

The essentially smooth surfaces of the drawer glide typically have a low coefficient of friction, further easing the opening and closing of a cabinet drawer. For example, the coefficient of friction is between approximately 0.07 and 0.3. More preferably, the coefficient of friction is between approximately 0.1 and 0.15.

To further reduce friction, the upper plateau and bottom portion of the drawer glide may be lubricated. Preferably, white lithium grease is used; however, any lubricant compatible with the material used to fabricate the drawer glide may be used.

The bottom portion of the drawer glide may further comprise a member bridging the top and bottom portions, forming an inner portion that is essentially hollow and comprises a plurality of supports. The horizontal side portion may further comprise a glide portion, wherein the glide portion connects the top portion with the bottom portion. The glide portion facilitates easy gliding of the cabinet drawer over the drawer glide, thus allowing the drawer to be easily opened and closed from the cabinet. The glide portion may be any size as appropriate in order to facilitate easy opening and closing of the cabinet drawer. Typically, the glide portion will be approximately half the width of the vertical side portion.

The stationary drawer glide can be configured in any appropriate shape that will easily facilitate the opening and closing of a cabinet drawer. Typically, the drawer glide is substantially symmetrical around a horizontal axis. The drawer glide may also be substantially symmetrical around a vertical axis. Most typically, the drawer glide is both substantially symmetrical around a horizontal axis and around a vertical axis. The drawer glide may have any cross-sectional shape that will allow for easy sliding of a cabinet drawer when closing or opening the cabinet drawer while still providing a strong and stable drawer glide. Typically, the drawer glide has a c-shaped cross-section.

The stationary drawer glide may further comprise an essentially hollow inner portion. The essentially hollow inner portion may further comprise a series of supports to support and strengthen the drawer glide. Typically, the inner portion will also comprise at least one fastener. The fastener can be any type of fastener, allowing the drawer glide to be connected to the inside of a cabinet or to a cabinet rail. Typically, the fastener will be a snap-in fastener to connect to a cabinet rail. More typically, the inner portion of the drawer glide will comprise two snap-in fasteners.

In accordance with another aspect of the invention, a cabinet drawer is provided. The cabinet drawer comprises a drawer body comprising a bottom, two opposing sides, a back, and a front, wherein said opposing sides comprise at least one recessed track; and a stationary drawer glide affixed to a cabinet rail comprising: a fastening portion adapted to be affixed to a cabinet wall comprising at least one fastening member; an elongated, substantially flat upper plateau, load-bearing top portion for supporting a drawer; an elongated, substantially flat, load-bearing bottom portion for supporting a drawer; at least one horizontal side portion; and two vertical side portions.

The recessed track may be slightly larger than the cabinet rail and drawer glide. The recessed track can then fit and glide over the cabinet rail and drawer glide, allowing for easy movement of the cabinet drawer within a cabinet. Typically, the cabinet drawer is essentially symmetrical around a vertical axis. Typically, at least one cabinet drawer is arranged within a cabinet body to form a file cabinet. More typically, a plurality of cabinet drawers are arranged within a cabinet body to form a multi-drawer file cabinet. The cabinet drawers may be arranged in any appropriate configuration within the cabinet body. Typically, the plurality of cabinet drawers are vertically aligned to form a vertical cabinet. Typically, the plurality of vertically aligned cabinet drawers are essentially symmetrical around a vertical axis.

BRIEF DESCRIPTION OF THE FIGURES

The accompanying drawings form part of the specification and like numerals are employed to designate like parts throughout the same.

DETAILED DESCRIPTION OF THE INVENTION

Figure 1:
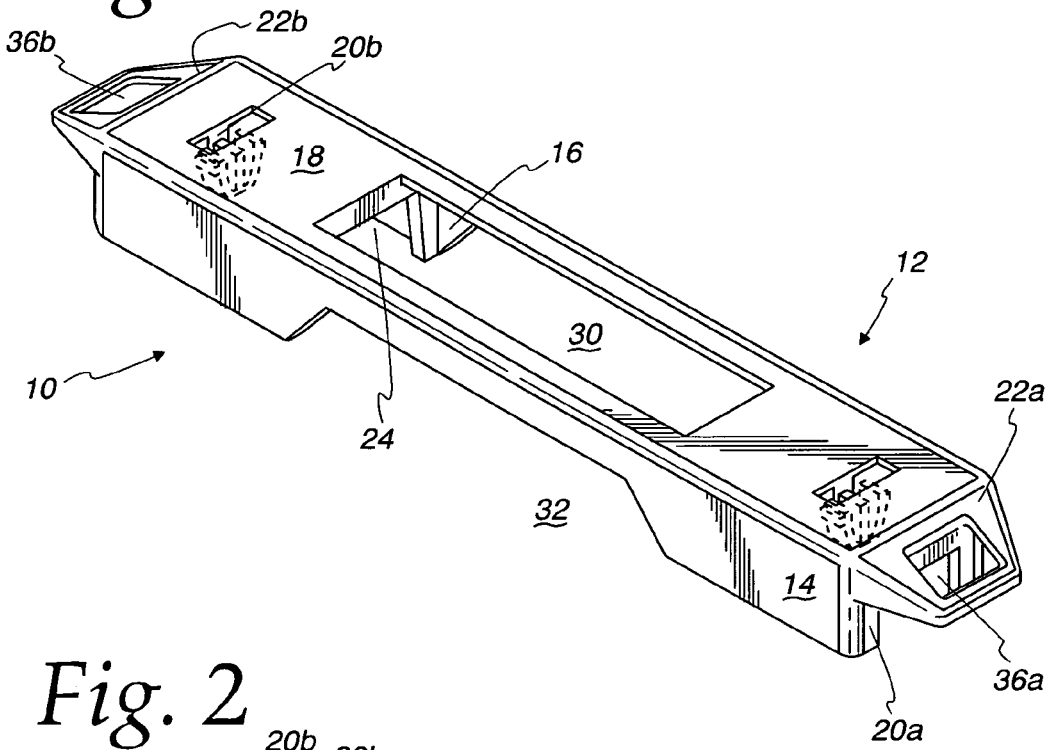
FIG. 1 is a perspective view of an embodiment of a drawer glide in accordance with the invention.

While this invention is susceptible of embodiment in many different forms, there is shown in the drawings and described in detail herein, several specific embodiments with the understanding that the present disclosure is to be considered as exemplifications of the principles of the invention and is not intended to limit the invention to the embodiments illustrated.

Figure 2:
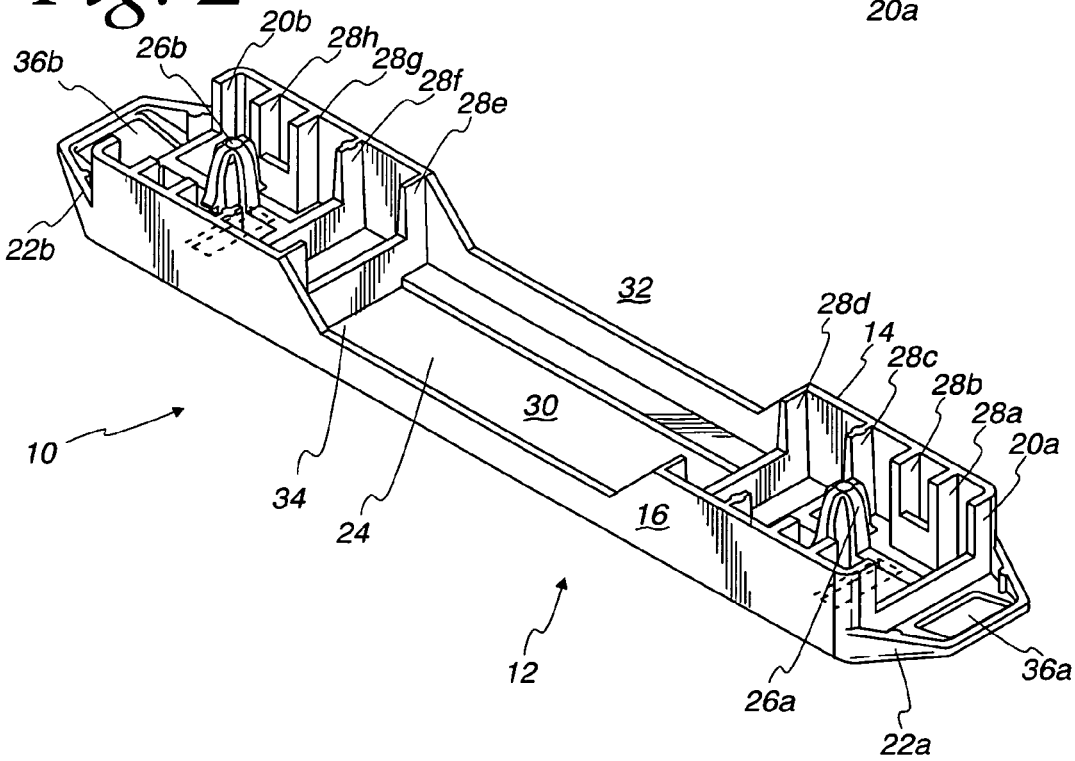
FIG. 2 is a perspective view of the bottom of an embodiment of a drawer glide in accordance with the invention.

Referring to the figures generally, and in particular to FIG. 1 and FIG. 2, a perspective view of a stationary drawer glide 10 is provided. Stationary drawer glide 10 comprises an integral body 12 as shown in FIGS. 1 and 2. Body 12 comprises an elongated, substantially flat upper plateau, load-bearing top portion 14 and an elongated, substantially flat, load-bearing bottom portion 16. Body 12 further comprises a horizontal side portion 18 and two vertical side portions 20 *a-b*. Horizontal side portion 18 further comprises glide portions 22 *a-b*.

Horizontal side portion 18, vertical side portions 20 *a-b*, top portion 14, and bottom portion 16, are connected and configured to form inner portion 24. Inner portion 24 is essentially hollow and comprises fasteners 26 *a-b* and a plurality of supports 28 *a-h*, which are integral to drawer glide 10 as shown in FIG. 2. Fasteners 26 *a-b* are snap-style fasteners. Supports 28 *a-h* provide additional load-bearing and structural support to top portion 14 and bottom portion 16. Supports 28 *a-h* are configured within inner portion 24 forming a generally c-shaped cross-section when drawer glide 10 is standing on and supported by bottom portion 16. Vertical side portions 20 *a-b* also form a generally c-shaped cross-section when drawer glide 10 is standing on and supported by bottom portion 16.

Horizontal side portion 18 further comprises a horizontal opening 30. Top portion 14 comprises top opening 32 and bottom portion 16 further comprises bottom opening 34. Vertical side portions 20 *a-b* further comprise vertical openings 36 *a-b*.

Figure 3:
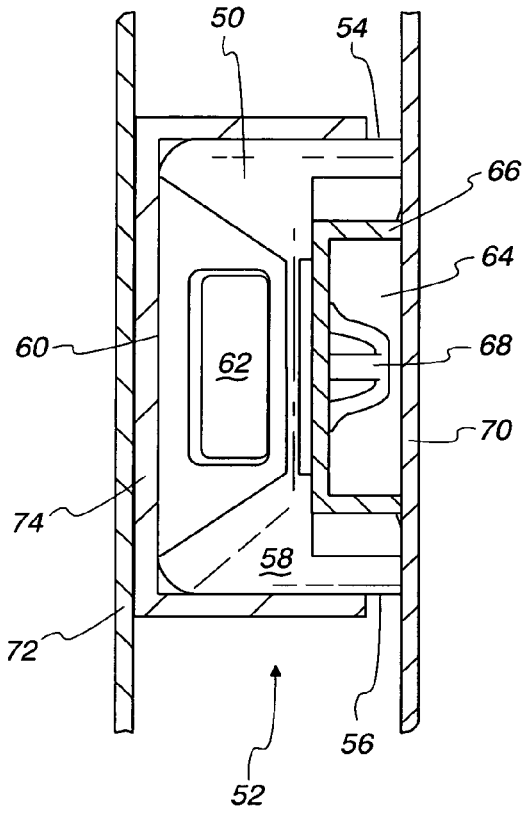
FIG. 3 is a front plan view of another embodiment of a drawer glide in a drawer track in accordance with the invention.

Referring to FIG. 3, a front plan view of a stationary drawer glide 50 in a drawer track 52 in accordance with the invention is provided. Drawer glide 50 comprises a load-bearing top portion 54 and a load-bearing bottom portion 56. Drawer glide 50 further comprises a vertical portion 58 and a horizontal portion 60. Vertical portion 58 comprises a vertical opening 62. Drawer glide 50 further comprises an inner portion 64 comprising a support 66. Support 66 provides additional load-bearing support to top portion 54 and bottom portion 56. Drawer glide 50 and inner portion 64 have a generally c-shaped cross-section.

Inner portion 64 further comprises a fastener 68, allowing drawer glide 50 to be affixed to a cabinet wall 70. Drawer glide 50 is securely fastened to cabinet wall 70. A cabinet drawer wall 72 has a drawer track 74 that is affixed around and glides over drawer glide 50.

Figure 4:
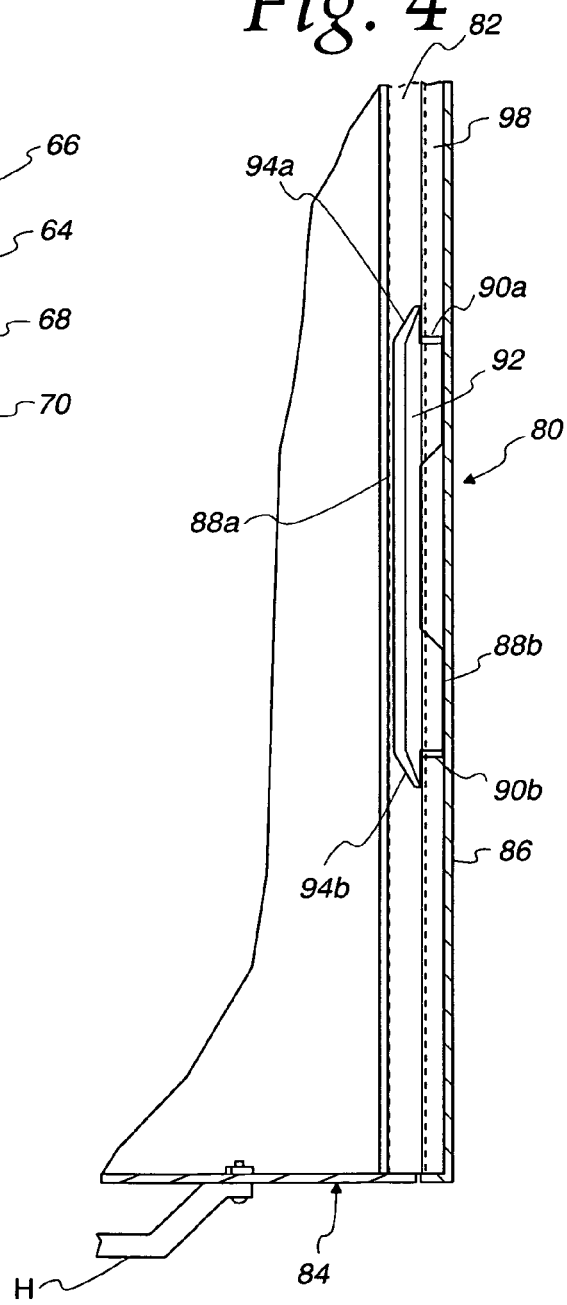
FIG. 4 is a top plan view of a cut-away portion of another embodiment of a drawer glide in a drawer track in accordance with the invention.

Referring to FIG. 4, a top plan view of a cut-away portion of a stationary drawer glide 80 on a cabinet track 82 affixed with a cabinet drawer 84 is provided. Drawer glide 80 is affixed to an interior cabinet wall 86. Drawer glide 80 comprises horizontal side portions 88 *a-b*, vertical side portions 90 *a-b*, and a load-bearing top portion 92. Vertical side portions 90 *a-b* further comprise glide portions 94 *a-b*. Glide portions 94 *a-b* are angled away from cabinet drawer 84, allowing cabinet drawer 84 to easily slide along cabinet track 82.

Cabinet drawer 84 comprises a handle H for opening and closing cabinet drawer 84 along cabinet track 82. Cabinet drawer 84 further comprises a recessed track 98 that envelopes drawer glide 80, allowing cabinet drawer 84 to slide along drawer glide 80.

Figure 5:
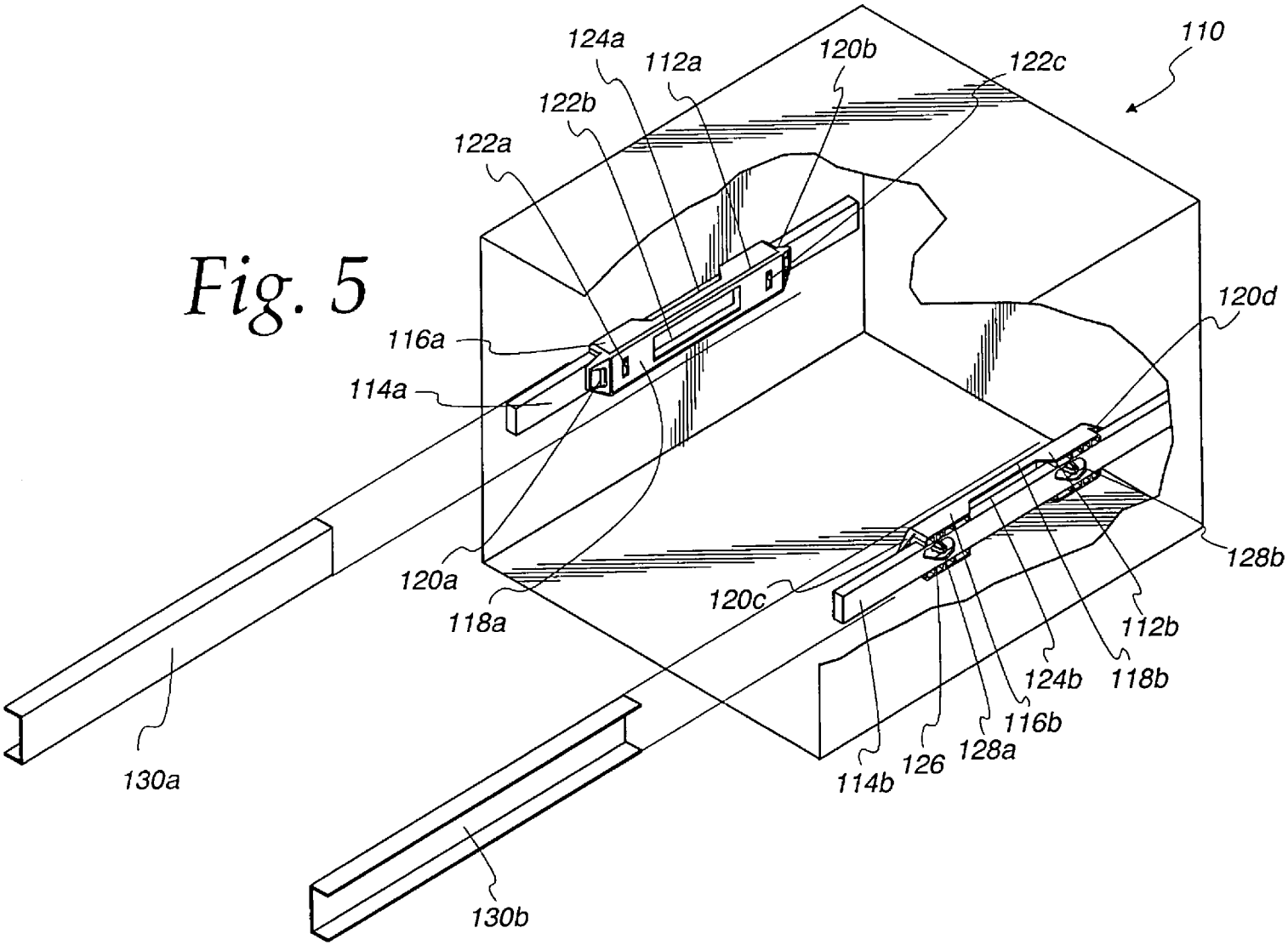
FIG. 5 is a perspective view of a cut-away portion of a cabinet and drawer glides in accordance with the invention.

Referring to FIG. 5, a perspective view of a cut-away portion of a cabinet 110 is provided. Stationary drawer glides 112 *a-b* are mounted on a cabinet track 114 a-b. Stationary drawer glides 112 *a-b* comprise a load-bearing top portion 116 *a-b*, a horizontal portion 118 *a-b* and vertical side portions 120 *a-d*. Horizontal side portions 118 *a-b* comprise horizontal openings 122 *a-c*. Drawer glides 112 *a-b* further comprise essentially hollow interior portions 124 *a-b*. Interior portions 124 *a-b* comprise load bearing supports 126 and fasteners 128 *a-b*. Fasteners 128 *a-b* affix drawer glides 112 *a-b* to cabinet tracks 114 *a-b*.

Drawer glides 112 *a-b* are essentially stationary once affixed to cabinet tracks 114 *a-b*. A cabinet drawer can slide on drawer tracks 130 *a-b* over and along drawer glides 112 *a-b*. Drawer tracks 130 *a-b* are affixed to a cabinet drawer and slide over drawer glides 112 *a-b*, allowing for easy opening and closing of a cabinet drawer in cabinet 110.

Figure 6:
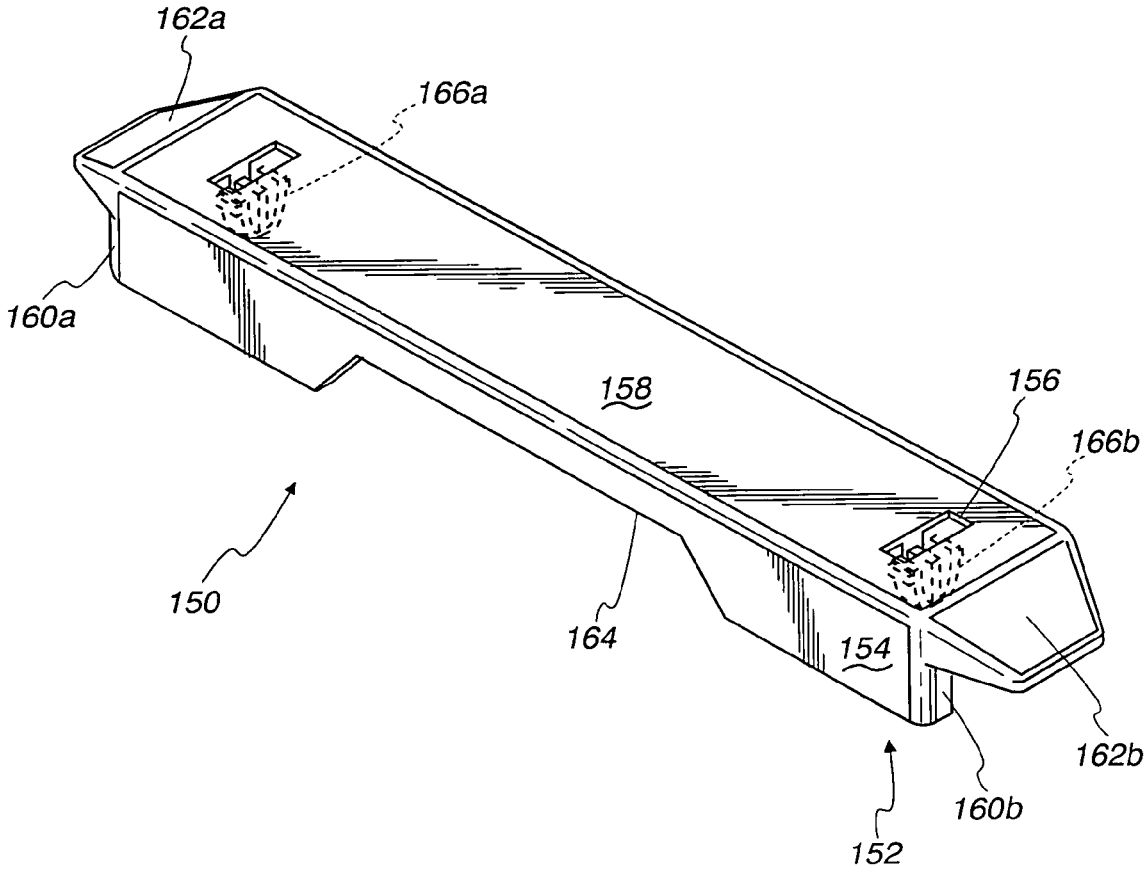
FIG. 6 is a perspective view of another embodiment of a drawer glide in accordance with the invention.

Referring to FIG. 6, a perspective view of an alternate embodiment of a stationary drawer glide 150 is provided. Stationary drawer glide 150 comprises a body 152. Body 152 comprises an elongated, substantially flat upper plateau, load-bearing top portion 154 and an elongated, substantially flat, load-bearing bottom portion 156. Body 152 further comprises a horizontal side portion 158 and two vertical side portions 160 *a-b*. As before, "horizontal" and "vertical" as used here refer to drawer glide 150 as shown in FIG. 6, and it will be understood that horizontal side portion 158 and vertical side portions 160 *a-b* will be oriented differently when drawer glide 150 is mounted to the inside wall of a cabinet. Horizontal side portion 158 further comprises glide portions 162 *a-b*.

Horizontal side portion 158, vertical side portions 160 *a-b*, top portion 154, and bottom portion 156, are connected and configured to form inner portion 164. Inner portion 164 is essentially hollow and comprises fasteners 166 *a-b* and a plurality of supports. Fasteners 166 *a-b* are snap-style fasteners. Supports provide additional load-bearing and structural support to top portion 154 and bottom portion 156. Vertical side portions 160 *a-b* form a generally c-shaped cross-section when drawer glide 150 is standing on and supported by bottom portion 156.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

I claim:

1. A stationary drawer glide, with a drawer, for attachment to a cabinet interior wall comprising:

an elongated, substantially flat upper plateau, load-bearing top portion for supporting the drawer;

an elongated, substantially flat, load-bearing bottom portion for supporting the drawer;

at least one horizontal side portion connected to the load-bearing top portion and the load-bearing bottom portion;

wherein each of the portions have an opening along the middle; a plurality of laterally and vertically extending longitudinally spaced apart generally C-shaped support members located within an inner surface of the horizontal side portion of the drawer glide, each of said support members extending from and being connected to the load-bearing top portion, the load-bearing bottom portion and the side portion;

a fastening portion on the inner surface of the horizontal side portion, adapted to be affixed to said cabinet interior wall, comprising at least one fastening member extending substantially perpendicularly from the horizontal side portion; and wherein the drawer comprises a track that envelops the drawer glide, allowing the drawer to slide along the drawer glide.

2. The stationary drawer glide of claim 1 further comprising two vertical side portions, wherein the support members are located between the vertical side portions and extend laterally from the horizontal side portion and bridge the load-bearing top and bottom portions, forming an inner portion that is essentially hollow.

3. The stationary drawer glide of claim 2 wherein the horizontal side portion further comprises a glide portion, wherein the glide portion connects the load-bearing top portion with the load-bearing bottom portion.

4. The stationary drawer glide of claim 3 wherein the glide portion extends approximately half the width of the vertical side portion.

5. The stationary drawer glide of claim 1 wherein the drawer glide is substantially symmetrical around a horizontal axis.

6. The stationary drawer glide of claim 1 wherein the drawer glide is substantially symmetrical around a vertical axis.

7. The stationary drawer glide of claim 1 wherein the drawer glide has a generally c-shaped cross-section.

8. The stationary drawer glide of claim 1 wherein the upper plateau has an essentially smooth surface.

9. The stationary drawer glide of claim 8 wherein the essentially smooth surface has a low coefficient of friction.

10. The stationary drawer glide of claim 8 wherein the upper plateau comprises high density polyethylene or an acetal copolymer.

11. The stationary drawer glide of claim 1 further comprising an essentially hollow inner portion.

12. The stationary drawer glide of claim 11 wherein the at least one fastening member comprises a plurality of fasteners located within the hollow inner portion.

13. The stationary drawer glide of claim 1 wherein the at least one fastening member is integral with the fastening portion.

14. The drawer glide of claim 1 wherein the at least one fastening member is a snap-in fastener.

* * * * *